United States Patent [19]

Köhnen et al.

[11] Patent Number: 4,731,097

[45] Date of Patent: Mar. 15, 1988

[54] GAS COOLING DEVICE FOR A GASIFER

[75] Inventors: Klaus Köhnen, Mühlheim; Hans Niermann; Norbert Ullrich, both of Essen, all of Fed. Rep. of Germany

[73] Assignee: Krupp Koppers GmbH, Essen, Fed. Rep. of Germany

[21] Appl. No.: 936,702

[22] Filed: Dec. 1, 1986

[30] Foreign Application Priority Data

Jan. 22, 1986 [DE] Fed. Rep. of Germany ..... 3601786

[51] Int. Cl.[4] ..... C10J 3/82

[52] U.S. Cl. ..... 48/76; 48/67; 48/87; 261/116; 422/207

[58] Field of Search ..... 48/67, 77, 63, 87, DIG. 2, 48/62 R, 76; 422/207, 208; 261/DIG. 54, 116; 55/267, 268, 269, 261, 263; 110/215; 122/5, 7 R

[56] References Cited

U.S. PATENT DOCUMENTS

| | | | |
|---|---|---|---|
| 4,157,244 | 6/1979 | Gernhardt et al. | 48/62 R |
| 4,172,708 | 10/1979 | Wu et al. | 48/62 R |
| 4,202,672 | 5/1980 | Schuurman | 48/77 |
| 4,323,366 | 4/1982 | Standinger | 48/63 |
| 4,343,626 | 8/1982 | Peise et al. | 48/67 |
| 4,369,163 | 1/1983 | Schingnitz et al. | 48/87 |
| 4,584,180 | 4/1986 | Ostrov | 422/207 |

FOREIGN PATENT DOCUMENTS

| | | |
|---|---|---|
| 2342079 | 4/1978 | Fed. Rep. of Germany . |
| 2526922 | 9/1985 | Fed. Rep. of Germany . |

*Primary Examiner*—Barry S. Richman
*Assistant Examiner*—Joye L. Woodard
*Attorney, Agent, or Firm*—Michael J. Striker

[57] ABSTRACT

A device for cooling a stream of hot producer gas exiting from a gasification reactor operating at an increased pressure, includes a set of water spraying nozzles directed against the producer gas stream. Water feeding conduits connected to the nozzles pass through a sealing web provided between the pipe wall structure of the reactor and a separate pipe wall structure of a gas outlet connection piece provided above the discharge opening of the reactor. The geometric locations of respective nozzles are on a circle whose diameter is larger than that of the gas discharge opening and is smaller than the inner diameter of the pipe wall structure of the connection piece.

3 Claims, 2 Drawing Figures

$D_A$
4
5
5
$D_W$
α
9
10
12
10
8
8
$D_G$
7
11
3
7
11
6
2
A
1
1

$D_A$
4
5
5
$D_{WD}$
$D_W$
17
17
α
9
10
10
12
8
8
$D_G$
3
16
7
13
13
7
16
15
15
14
11
6
2
A
1
1

GAS COOLING DEVICE FOR A GASIFER

BACKGROUND OF THE INVENTION

The present invention relates in general to a gasification reactor operating at an increased gas pressure and including a tubular first pipe wall structure having a circular gas discharging opening on its top, an outlet connection piece including a tubular second pipe wall structure concentrically surrounding the gas discharging opening and being sealingly connected to the first pipe wall structure, and two separating cooling circuits for supplying a cooling medium through respective pipe wall structures. In particular, this invention relates to a cooling device including water spraying nozzles directed against the hot stream of producer gas exiting from the reactor.

Reactions taking place in a gasification reactor between the fuel, for example finely pulverized coal and the gasifying oxygen and steam produce final gasification temperatures between about 1300° to 1600° C. Depending on the softening behavior of fuel ashes at higher temperatures, it is required that the hot crude gas exiting from the interior of the reactor be cooled in a suitable manner below the softening point of ash particles entrained in the gas stream in order to prevent their caking and deposition during further processing.

The cooling of the hot crude gas also called quenching, can be made by admixing thereto a fedback stream of cool producer gas or by steam or by a direct spray of water. In spraying water the cooling of the crude gas results from the removal of enthalpy needed for vaporization of water as well as from the heating of stream to the quenching end temperature of the gas.

It is known to supply a cooling medium, particularly water into gasification installations operating substantial under normal pressure, through conduits opening into a gas outlet connection piece which is usually designed in the form of a double jacket arranged downstream of the gasification reactor.

In gasification installations operating at an increased pressure this prior art arrangement of spraying nozzles is not feasible in practice inasmuch as the gas outlet connection piece as well as other parts of the installation for stability reasons are designed preferably as pipe wall structures. Such pipe wall structures, however, do not allow the feed through of the supply conduits for the cooling medium for the nozzles without causing disturbances on the inner side of the pipe wall that is attacked by the discharged hot gas. The points of penetration of the supply conduits into the pipe wall structure enhance the baking on of streaming ash particles as well as various erosion phenomena.

SUMMARY OF THE INVENTION

It is, therefore, an object of this invention to avoid the disadvantages of prior art gas cooling devices of this kind. In particular it is an object of this invention to provide an improved supply of cooling medium into a stream of hot raw gas exiting from a gasification reactor operating at an increased pressure which is not possessed by the aforementioned disadvantages.

In keeping with these objects and others which will become apparent hereafter, one feature of this invention resides in feeding the water supply conduits for respective water spraying nozzles in the interior of the gasification system, between two separate pipe wall structures of the gasification reactor and of the gas outlet connection piece, and the nozzles are arranged along a circular section whose diameter is larger than that of the gas outlet opening of the pipe wall structure of the reactor and is smaller than the inner diameter of the tubular pipe wall structure of the gas outlet connection whereby both pipe wall structures are supplied by a cooling medium from separate cooling circuits.

Accordingly, in the arrangement according to this invention the water supply conduits for the water spraying nozzles penetrate into the inner spacee of the gasification system in the separation zone of the adjoining pipe wall structures of the gasification reactor and of the gas outlet connection piece and consequently the pipe wall structures themselves are out of contact with the water supply conduits and therefore no negative effects on the stream and no baking on or erosion on the inner sides of the pipe wall structures can occur. The arrangement of the water spraying nozzles on the beforementioned circular section has the advantage that the nozzles are located leeward the exiting gas stream and consequently are not subject to clogging by solid particles entrained in the gas stream.

The orientation of the nozzles can be adjusted such that the spray is directed against the stream of crude gas, or perpendicularly thereto or on its streaming direction or in an intermediate position relative to the streaming direction. The number and size of the nozzles depends on specific requirements, that means on the intended cooling effect.

In a further elaboration of this invention, apart from the water spraying nozzles arranged on a circular section, there are also arranged water-steam spraying nozzles directed against the inner side of the pipe wall structure of the connection to remove possible cakings on the inner wall of the gas outlet connection piece. In this embodiment, the water spraying nozzles and the water-stream spraying nozzles are preferably alternately arranged on the circular section.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
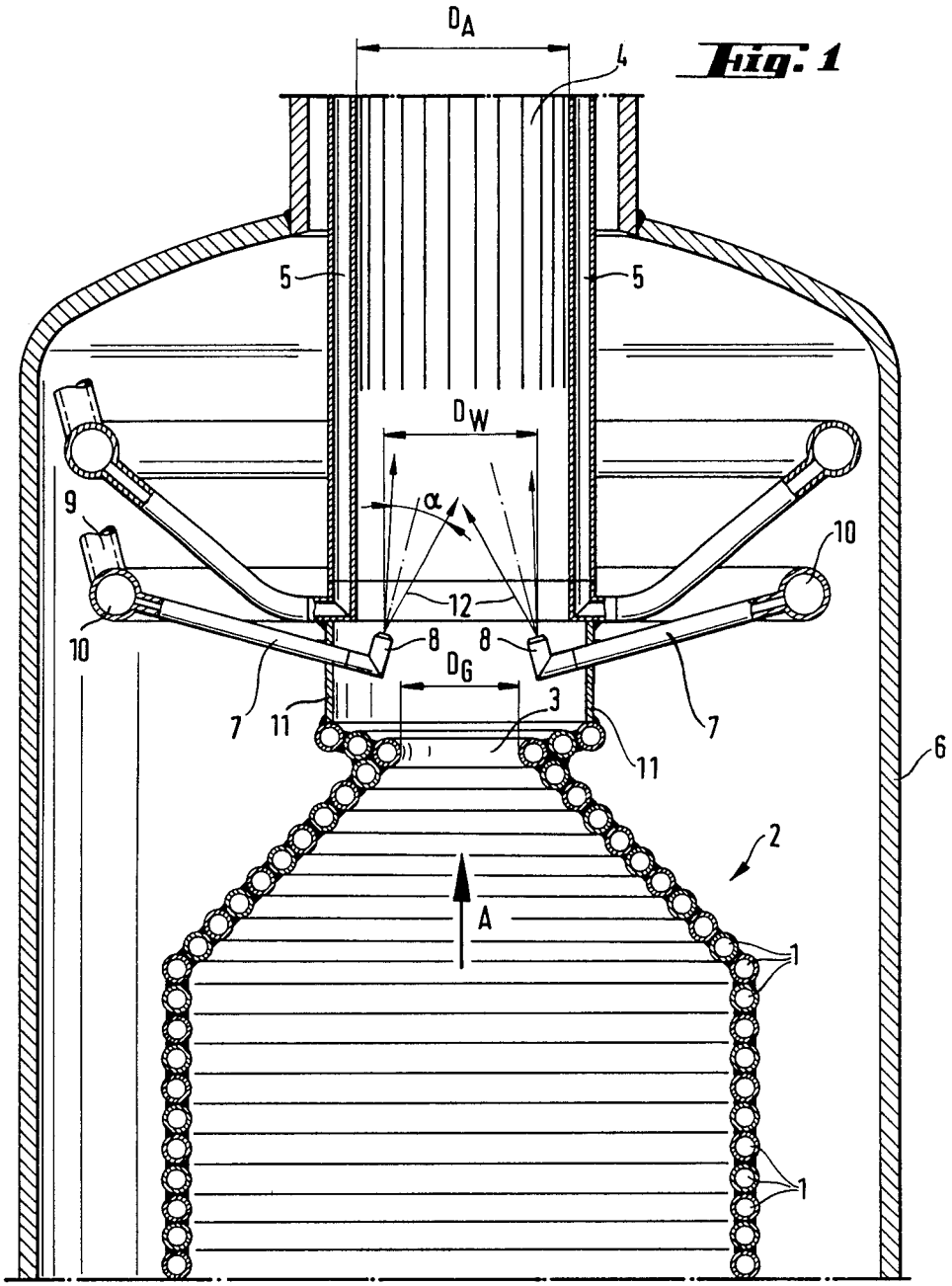
FIG. 1 is a cross section of a cutaway part of a gasification reactor in the area of its gas outlet opening provided with water spraying nozzles arranged therein.

In the figures, reference numeral 1 designates a tubular pipe wall structure of a gasification reactor 2 provided on its top with a gas discharge opening 3. Crude gas generaed in the reactor streams through the discharge opening 3 in the direction of arrow A and flows through a gas outlet connection piece 4 which surrounds the outlet opening. The gas outlet connection piece 4 is formed by a separate tubular pipe wall structure 5. As illustrated in the figures, both pipe wall structuress 1 and 5 are mutually independent systems each connected to a separate cooling circuit. Both systems are accommodated within a common pressure jacket 6. According to this invention, water supply conduits 7 are directed into the interior of the gasification system through a sealing web 11 between the two pipe wall structures 1 and 5 and are terminated by the water spraying nozzles 8. Reference numerals 9 and 10 denote respectively water feed-in lines 9 and water collecting pipe 10 communicating both with the lines 9 and with the water supply conduits 7. The sealing web 11 provides a gas tight closure between the separate pipe wall structures.

The water spraying nozzles 8 are arranged along a circular section having a diameter $D_W$ which is greater than the diameter $D_G$ of the gas discharge opening 3 of the pipe wall structure 1 but is smaller than the inner diameter $D_A$ of the pipe wall structure of the gas outlet connection piece 4. Accordingly, the nozzles 8 are arranged leeward the stream of crude gas flowing in the direction of arrow A. Preferably, the nozzles are uniformly distributed on the circular section of the diameter $D_W$ whereby the number and the size of the nozzles as well as the angle alpha the water spray cone 12 are determined according to operational requirements. In the illustrated example of FIG. 1, the nozzles are directed obliquely toward the center axis of the gas stream A. As mentioned before, however, the orientation of the nozzles can be arbitrary depending on the desired effect.

Figure 2:
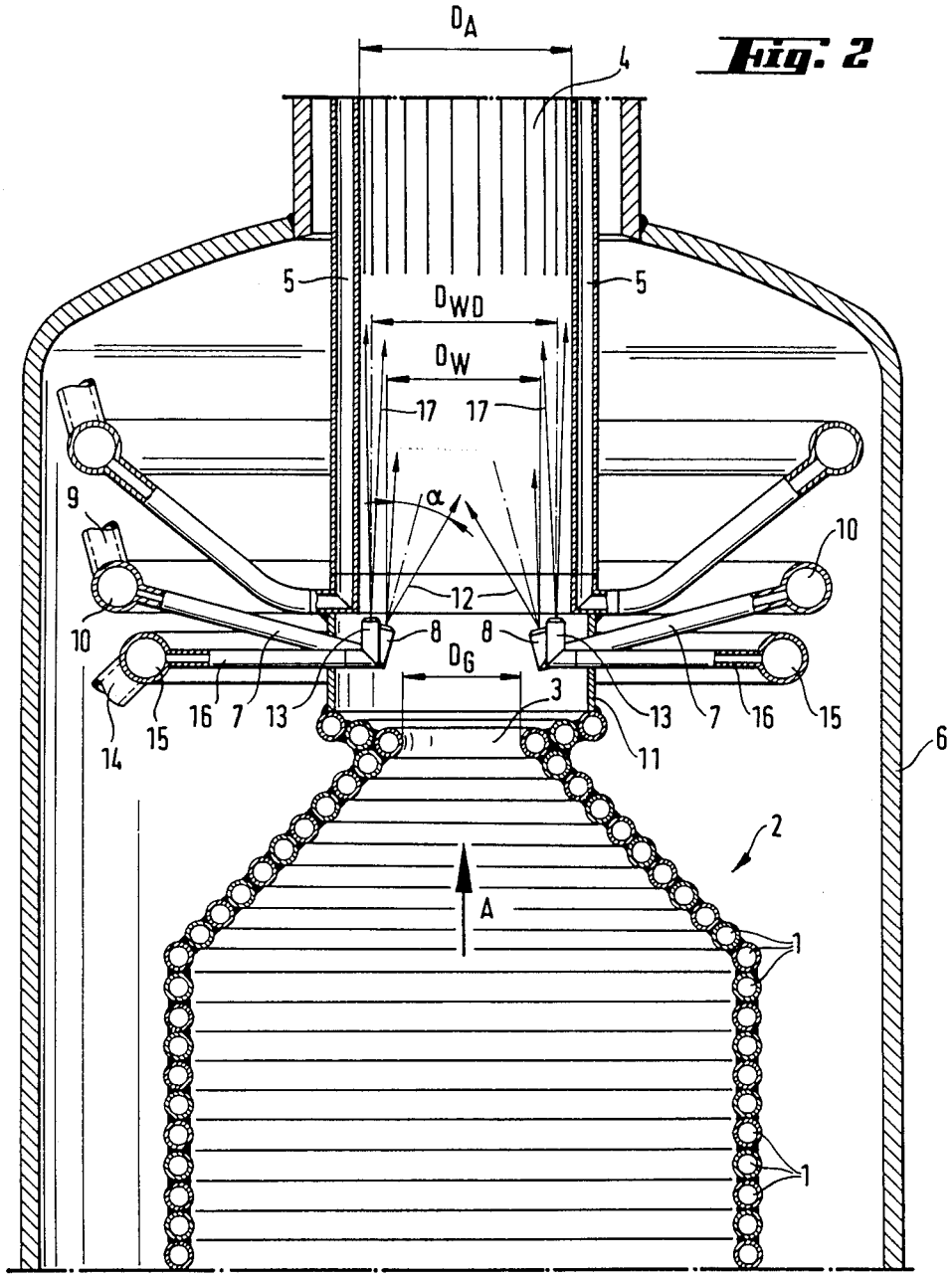
FIG. 2 is a sectional view similar to FIG. 1 showing additional water-steam spraying nozzles according to this invention.

In FIG. 2, structural elements corresponding to FIG. 1 are designated by like reference numerals. In this embodiment, in addition to water spraying nozzles 8, there are also provided along the circular section of diameter $D_W$ steam spraying nozzles 13. Preferably, the nozzles 13 alternate with the nozzles 8. The supply of steam to the nozzles 13 is provided through steam feedin lines 14, a steam collection pipe 15 and steam supply conduits 16 which similarly as the water supply conduits 7 are fed through the sealing web 11 to open into the interior of the gasification system. The steam cone 17 emanating from each of the nozzles 13, as illustrated in FIG. 2, is directed against the inner side of the pipe wall structure 5 of the connection piece 4. The steam jet serves for an effective removal of deposits and possible bakings on the inner surface of the structure 5. The number, size, inclination and arrangement of the steam spraying nozzles is dependent on particular cleaning requirements.

What is claimed as new and desired to be protected by Letters Patent is set forth in the appended claims.

1. A gasification reactor including a tubular first pipe wall structure enclosing a reaction space wherein a hot producer gas is generated at an increased pressure by reaction between a pulverized fuel and oxygen, said first pipe wall structure having a constricted end portion forming a circular gas discharge opening, a gas outlet connection piece including a tubular second pipe wall structure coaxially arranged above said gas discharge opening and having an inner diameter which exceeds an inner diameter of said discharge opening, and a sealing means connecting a lower end of said second pipe wall structure to a rim of said constricted end portion of the first pipe wall structure, means for circulating a cooling medium through pipes of the respective pipe wall structures, a device for cooling a stream of hot producer gas exiting through gas discharge opening comprising a plurality of water feeding conduits having ends projecting through said sealing means, each of said ends of the water feeding conduits being provided with a water spraying nozzle directed downwardly against the exiting stream of producer gas, said nozzles being located around a center axis of said second pipe wall structure in a region determined by a circle whose diameter is larger than said inner diameter of the gas discharge opening but smaller than said inner diameter of the second pipe wall structure.

2. A gasification reactor as defined in claim 1, and further comprising a plurality of steam feeding conduits having ends projecting through said sealing means each of said ends of the steam feeding conduits terminating with a steam feeding nozzle located on said circle and directed upwardly against the inner side of said second pipe wall structure to remove possible baked on deposits.

3. A gasification reactor as defined in claim 2, wherein said water spraying nozzles and said steam spraying nozzles are alternately arranged on said circle.

* * * * *